US008276534B2

(12) United States Patent
Mochizuki

(10) Patent No.: US 8,276,534 B2
(45) Date of Patent: Oct. 2, 2012

(54) BOAT

(75) Inventor: Yasushi Mochizuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 222 days.

(21) Appl. No.: 12/395,801

(22) Filed: Mar. 2, 2009

(65) Prior Publication Data

US 2009/0227157 A1 Sep. 10, 2009

(30) Foreign Application Priority Data

Mar. 5, 2008 (JP) ..... 2008-054322

(51) Int. Cl.
*B63B 1/00* (2006.01)

(52) U.S. Cl. ..... 114/56.1

(58) Field of Classification Search ..... 114/56.1, 114/61.2, 61.21, 61.27, 61.29, 61.3, 61.31, 114/61.32, 255
See application file for complete search history.

(56) References Cited

U.S. PATENT DOCUMENTS 2,999,254 A * 9/1961 Nolde ..... 114/356
4,106,426 A * 8/1978 Wertz ..... 440/62
4,473,026 A * 9/1984 Bass ..... 114/255
5,566,637 A * 10/1996 Benza ..... 114/343
6,287,161 B1 * 9/2001 Nozawa ..... 440/77

FOREIGN PATENT DOCUMENTS

JP 09-207888 A 8/1997
JP 2005-212705 A 8/2005

OTHER PUBLICATIONS

Mochizuki; "Boat Body and Boat Including the Same"; U.S. Appl. No. 12/395,797, filed Mar. 2, 2009.
http://www.outboardcovers.com/leg.htm; retrieved Jun. 29, 2012; 3 pages.

* cited by examiner

*Primary Examiner* — Daniel Venne
(74) *Attorney, Agent, or Firm* — Keating & Bennett, LLP

(57) ABSTRACT

A boat includes a recess arranged in a middle, as viewed in a horizontal direction, of a stern, and outboard motors installed on an installation portion provided in the recess such that the boat driven by the outboard motors. A transom platform is located at left, right, and front sides of the recess so that a crew is allowed to walk on the transom platform. A rear portion of each of the left portion and the right portion of the transom platform projects rearward beyond the outboard motors. The starboard-side step of the transom platform has a step, while the port-side step has a step. A storage portion is arranged below the fore step, and a storage portion is arranged in a rear portion of the port-side step. The boat allows for an effectively usable large space to be provided in the boat body and allows for easy movement around the outboard motors.

11 Claims, 4 Drawing Sheets

BOAT

BACKGROUND OF THE INVENTION

1. Field of the Invention

The present invention relates to a cruiser type boat arranged to run by driving an outboard motor disposed on a stern of the boat.

2. Description of the Related Art

Conventionally, so-called cruiser type boat shaving a rather large size and various kinds of facilities necessary for ocean sailing are used for leisure. In such boats, in general, an apparatus such as an engine is disposed in a stern of a boat body, while a drive unit is disposed on the outside of the boat body thereby rotating a propeller, or an apparatus such as an engine is disposed in a center portion of the boat body and a propeller extending outward from the boat body is rotated by a driving force provided by the engine via a propeller shaft. The former configuration is called an inboard-outboard motor configuration, while the latter configuration is called an inboard motor configuration. In such conventional cruiser type boats, locating the driving apparatus in the inside of the boat body results in a reduction in space in the boat body, and thus it is difficult to find sufficient space for installing various kinds of devices or for relaxing.

In view of the above, a boat has been developed which is configured to be driven by an outboard motor without locating a driving engine in the inside of the boat body (for example, see JP-A-Hei 9-207888). In this boat, an outboard motor installation portion is provided on the transom on the stern of the boat, and the outboard motor is installed on this outboard motor installation portion. Furthermore, an upper portion, a front portion, and both side portions of the outboard motor are covered with an outboard motor cover. Stern steps with a space that allows a crew to sit therein are provided at both sides of the outboard motor. This configuration allows noise from the outboard motor to be blocked and also allows the upper surface of the outboard motor cover to be used as a table.

However, in the conventional boat described above, there is no passageway for a connection between the stern steps provided at either side of the outboard motor. Therefore, for example, when a crew gets aboard the boat from one of the stern steps and further moves to the other stern step, the crew has to first move to one side of the stern deck from the one stern step, then move to the other side of the stern deck, and finally move to the other stern step from the stern deck. In such a movement, if the boat is of a cruiser type with a rather large size in which the stern deck is located higher than the stern steps, then a further troublesome movement is necessary to get from one of the stern steps to the other. Furthermore, in the conventional boat described above, although an outboard motor is used, the height of the stern deck from the bottom of the boat is not very large, and thus it is difficult to provide an effectively usable space in a bottom region in the body of the boat.

SUMMARY OF THE INVENTION

In order to overcome the problems described above, preferred embodiments of the present invention provide a boat configured to allow an effectively usable large space to be provided in a boat body and allow easy movement around an outboard motor.

According to a preferred embodiment of the present invention, a cruiser type boat includes a cabin and a cockpit provided in the boat, and the cockpit is located at a higher level than the cabin. The boat includes an outboard motor installation recess arranged in the middle of a stern of a boat body as viewed in a horizontal direction of the boat, in which an outboard motor is installed on a front wall of the recess, the boat is capable of running by driving the outboard motor, and thereby extra space is provided in a bottom portion of the boat body of the boat.

In the configuration according to the present preferred embodiment, the boat has a rather large boat body of a cruiser type, and the boat of the cruiser type runs by the driving force provided by the outboard motor. This makes it unnecessary to locate a driving engine in the stern of the boat body or in a bottom portion in a center portion of the boat body, and thus it becomes possible to create extra space that can be used for other purposes. Preferably, the space is used to install various kinds of devices and members necessary for the boat to run.

More specifically, for example, the space may be used to install an electric generator, a fuel tank, a fresh water tank, and/or a battery, and it is possible to expand the space in which the crew is allowed to relax. In the case of the boat of the cruiser type, there is a large difference in height between the deck and the bottom of the boat body, and the outboard motor is installed at a location lower than an upper portion of the boat body. This causes the outboard motor to be hidden in view as seen from the inside of the boat, and thus causes an increase in the appearance of the boat. Furthermore, noise from the outboard motor is attenuated to a low level that is almost inaudible by the crew inside the boat. It should be noted that in the preferred embodiments of the present invention, the term "cabin" generally represents a space in which the crew is allowed to rest or relax. Specific non-limiting examples of cabins include a main cabin, an under berth, and a bow berth. The positional relationship between the cabin and the cockpit that is located higher than the cabin is preferably represented in terms of floors thereof. For example, the floor of the cockpit may be lower than the ceiling of the main cabin.

According to another preferred embodiment of the present invention, the boat further includes passageways provided at left, right, and front sides of the outboard motor installation recess such that a crew is allowed to walk on the passageways. This configuration makes it possible to allow the crew to freely move around the outboard motor in the stern portion of the boat body, except for an area behind the outboard motor.

According to another preferred embodiment of the present invention, the boat is configured such that a rear portion of each of the passageways disposed at the right and left sides of the outboard motor installation recess projects rearward beyond a position corresponding to a rear end of the outboard motor. This configuration makes it possible to protect the outboard motor by the rear portions of the passageways thereby preventing the outboard motor from being damaged when the stern of the boat is brought into contact with a quay or the like or when some object hits the stern from the rear. Furthermore, it becomes possible for the crew to move over a greater range around the outboard motor.

According to another preferred embodiment of the present invention, the boat is configured such that the passageways have a step or a sloped portion such that a front portion is higher than a rear portion. This configuration makes it possible for the crew to more easily get on or off the boat by using the rear portion of either passageway as a step when the crew gets on or off the boat. By raising the front portion of the passageways with respect to the rear portion, it becomes possible to increase the height of the deck, which makes it possible to provide a large storage space below the deck. That is, it becomes possible to provide a boat that allows the crew to easily get on or off and that allows an effectively usable space to be provided in the boat. Furthermore, it becomes possible for the crew to easily move between the getting-on or off step at the lower position and the deck at the higher position.

According to another preferred embodiment of the present invention, the boat further includes a storage portion arranged to store devices, and the storage portion is located below a designated portion of the passageways. For example, in a case where the storage portion is provided below the portion of the passageway in front of the outboard motor installation recess, the upper surface of the storage portion may be defined by a closable plate with a hinge, and a boat hook in the form of a rod or other suitable shape may be placed in the storage portion. This makes it possible to take the boat hook out of the storage portion and perform an operation to bring the boat alongside a pier using the boat hook. In a case where a storage portion is provided below at least one of the passageways located at right and left sides of the outboard motor installation recess, the upper surface of this storage portion may have a closable plate with a hinge, and a foldable ladder or the like may be placed in this storage portion. This configuration makes it possible for the crew to use the ladder hung down from the passageway to enter the water for the purpose of swimming or diving.

According to another preferred embodiment of the present invention, the boat further includes a projecting portion arranged to project rearward from a transom on the stern of the boat, and the outboard motor is installed on the projecting portion. In this configuration, the provision of the projecting portion causes the outboard motor to be located further rearward. However, the crew is allowed to freely move around the outboard motor in the stern portion of the boat body, except for an area behind the outboard motor.

According to another preferred embodiment of the present invention, the boat is configured such that a plurality of outboard motors are provided in the outboard motor installation recess such that the outboard motors are located side by side in a horizontal direction of the boat. This configuration makes it possible to provide a boat capable of outputting a driving force required to drive the boat even when the size of the boat is increased. Furthermore, when the size of the boat body is increased, it is still possible for the crew to freely move about in both side areas of the stern.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
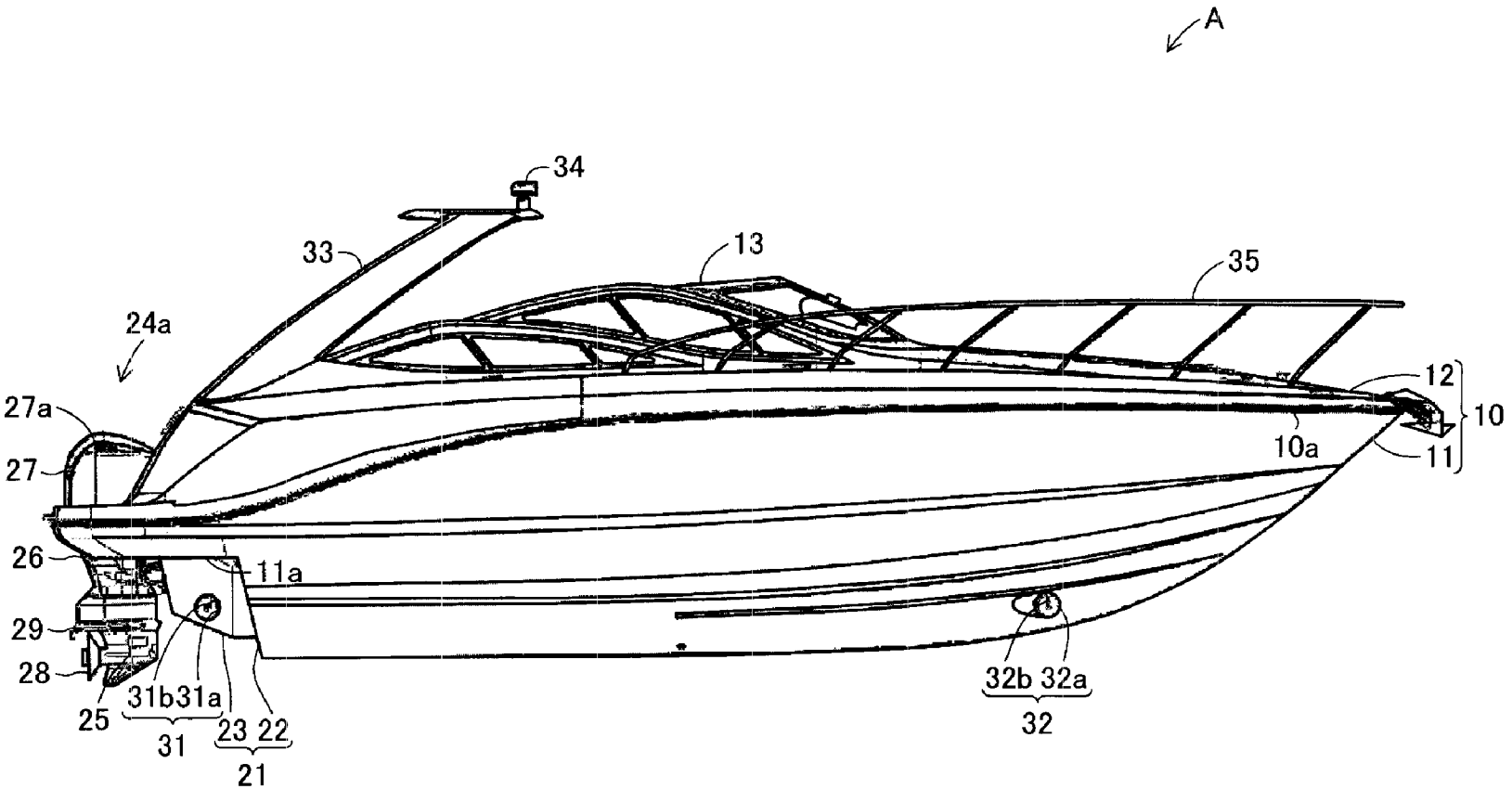
FIG. 1 is a side view of a boat according to a preferred embodiment of the present invention.
Figure 2:
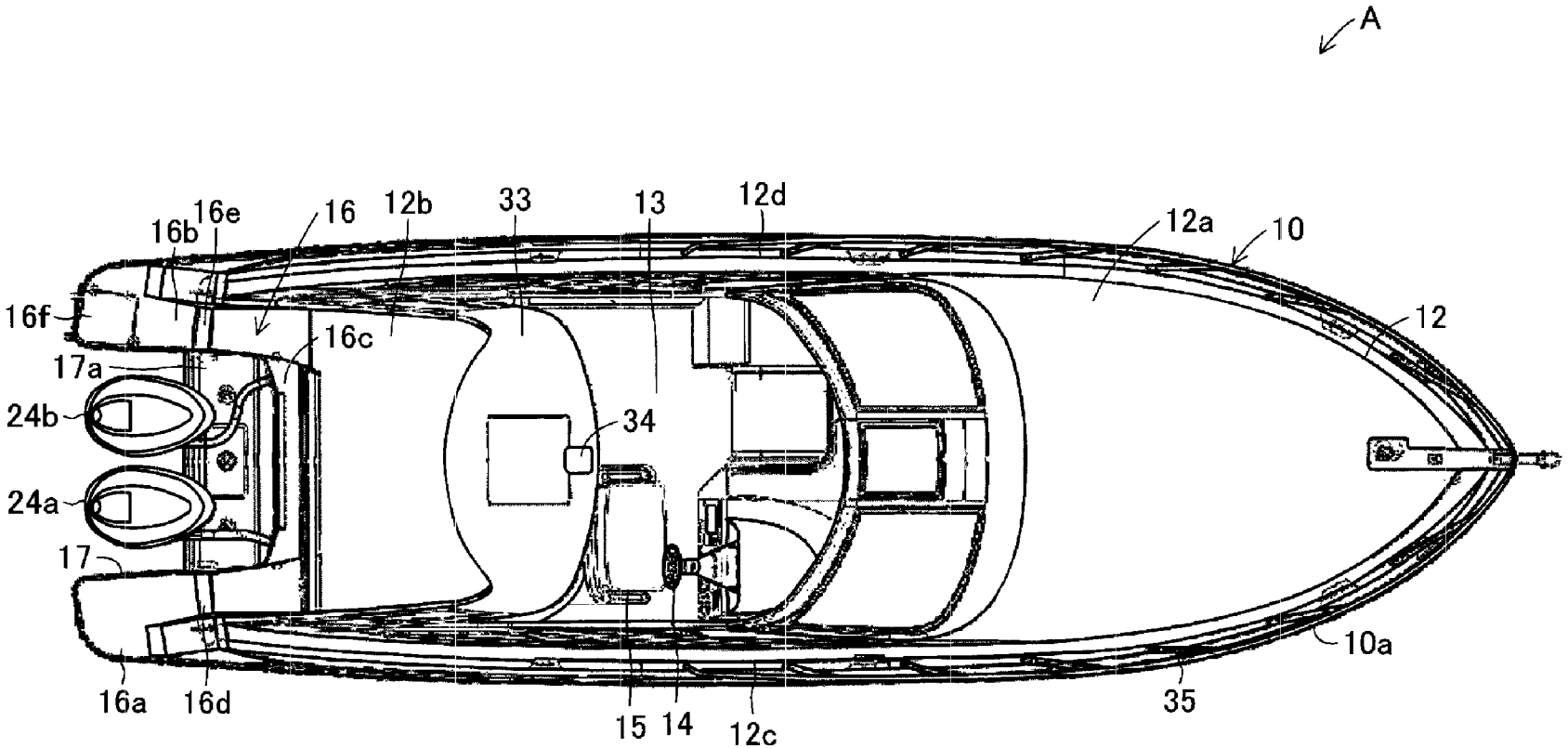
FIG. 2 is a plan view of the boat.
Figure 3:
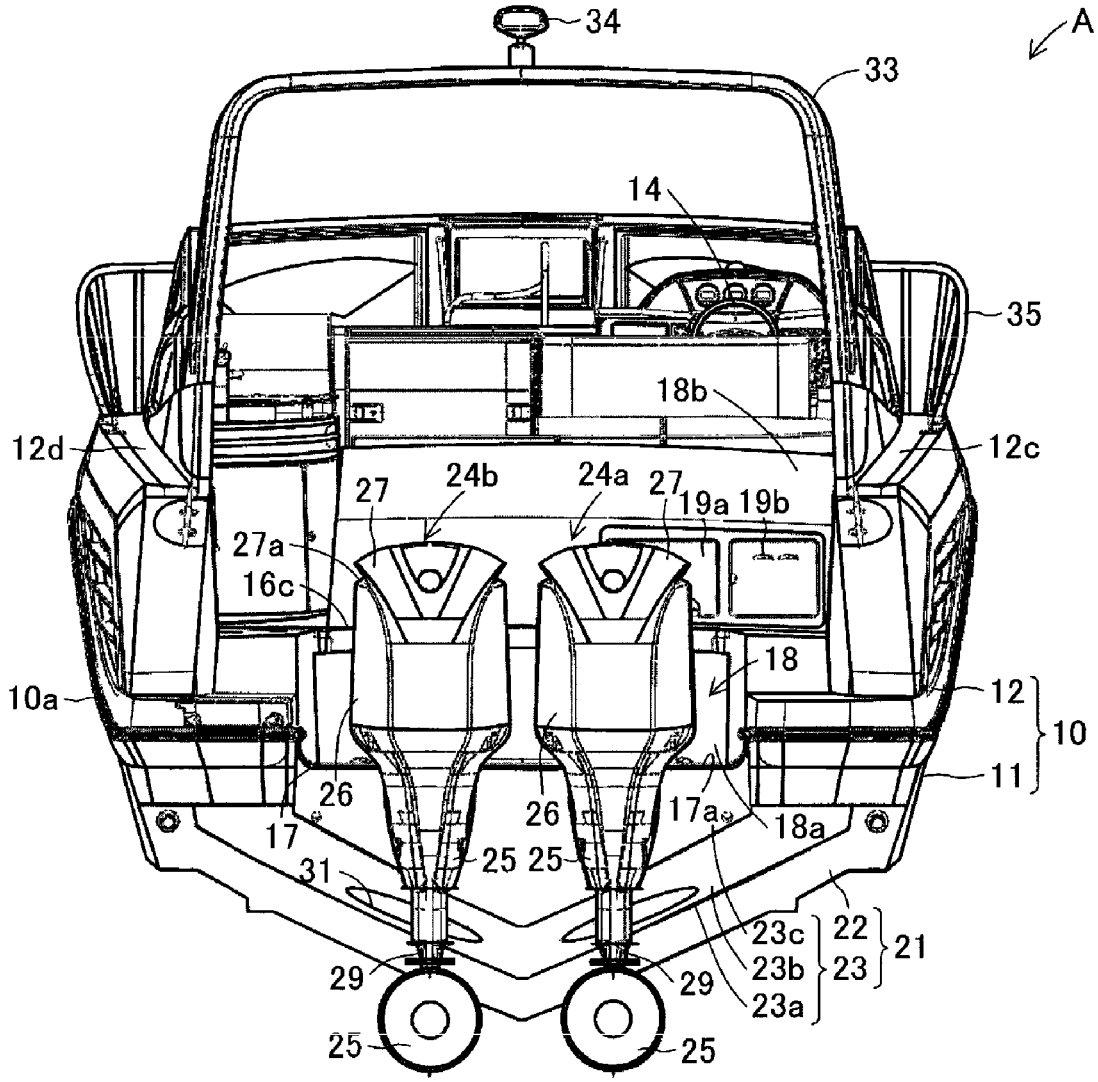
FIG. 3 is a rear view of the boat.

Preferred embodiments of the present invention will be described below with reference to the drawings. FIGS. 1 to 3 illustrate a boat (A) of a cruiser type according to the present preferred embodiment. In this boat (A), a boat body 10 includes a hull 11 defining a bottom portion of the boat body, and a deck 12 defining a top board. Peripheral portions of the hull 11 and the deck 12 are water-tightly connected to each other so as to define a gunwale portion 10*a* at a periphery of the boat body 10. A cockpit 13 with an open ceiling is provided in an upper portion of the boat body 10 in an area from substantially the middle to the rear end as viewed in a fore-and-aft direction (the cockpit may include an open space that is not a room). On the starboard side in the cockpit 13, a steering wheel 14 and an operator's seat 15 are provided in tandem. In the vicinity of the steering wheel 14, there are provided various kinds of devices, such as a start switch, a meter, an operating lever for an acceleration/deceleration operation, etc., necessary for steering the boat (A).

A bow deck 12*a* including a large flat area is provided on the upper surface of the deck 12 in a region in front of the cockpit 13. A stern deck 12*b* including a flat area with a smaller area than the bow deck 12*a* is provided on the upper surface of the deck 12 in a region at the rear of the cockpit 13. The bow deck 12*a* and the stern deck 12*b* are connected to each other via narrow passageways 12*c* and 12*d* extending in a front-back direction at right and left sides of the cockpit 13. A transom platform 16 with a generally U-shape in plan view is provided in a lower rear portion of the stern deck 12*b*.

That is, in the middle of the rear portion of the boat body 10, there is a recess 17, which is substantially rectangular in plan view and opened at its rear end and which functions as an outboard motor installation recess according to the present preferred embodiment. The recess 17 is completely hollow in a vertical direction (a projecting portion 23 described below is disposed at a lower front position in the recess 17). The transom platform 16 functioning as a passageway according to the present preferred embodiment is arranged so as to extend along the two sides and along the front side of the recess 17. The transom platform 16 includes a starboard-side step 16*a* located on the starboard side of the stern, a port-side step 16*b* located on the port side of the stern, and a fore step 16*c* connecting a front portion of the starboard-side step 16*a* and a front portion of the port-side step 16*b*.

A step 16*d* is provided at substantially the center, as seen in the fore-and-aft direction, of the starboard-side step 16*a*. A step 16*e* is provided at substantially the center, as seen in the fore-and-aft direction, of the port-side step 16*b*. By providing these steps 16*d* and 16*e*, the fore portion is made higher than the aft portion for both the starboard-side step 16*a* and the port-side step 16*b*. The fore step 16*c* is at the same height as the fore portion of the starboard-side step 16*a* and the fore portion of the port-side step 16*b*. Below the fore step 16*c*, there is a storage portion 18 with a substantially rectangular shape that extends in the horizontal direction. In this storage portion 18, a boat hook (not shown) with a long rod shape having a hook formed at its end can be provided.

A front portion of the fore step 16*c* is connected to the stern deck 12*b* via a hinge (not shown) such that the storage portion 18 can be opened by raising a rear portion. A step is provided between the fore step 16*c* and an upper surface of an installation portion 17*a* on which a pair of outboard motors 24*a* and 24*b* described below is installed. A fender (not shown) in the form of an elevating frame is attached to a vertical wall 18*a* (including a rear wall of the storage portion 18 and a lower-portion wall thereof) that forms the step. This fender preferably includes a plurality of sections formed by partitioning, by using connection bars, the inside of the rectangular frame that is long in a horizontal direction. The fender is vertically movable between the vertical wall 18*a* and a horizontal position in the rear of the vertical wall 18*a*. When used, the fender is tilted into the horizontal position in the rear of the vertical wall 18*a*. Long and narrow cushions for use in getting to a shore may be vertically placed in the respective sections.

On the starboard side of the lower portion of the vertical wall 18*b* located in the front of the fore step 16*c*, a feed portion 19*a* having a fuel feed port and a water feed port and an electric power supply port 19*b* having an outlet are arranged such that the feed portion 19*a* and the electric power supply port 19*b* are located side by side in a horizontal direction. A closable storage portion 16*f* is provided in a rear portion of the port-side step 16*b*, and a foldable ladder is placed therein. When a crew enters the water, this ladder can be hung down so that the crew can climb down using the ladder. A ladder (not shown) is provided on the inner surface of each of the walls respectively located on both sides of the transom platform 16 so that the crew is allowed to move to the passageway 12*c* or 12*d* from the transom platform 16 by using the ladder.

As shown in FIG. 1, a recess 11*a*, which is open at its rear end and at its bottom, is provided in a lower portion of a rear portion of the hull 11. A transom bottom 21 with a double ender shape is provided in a front portion of the recess 11*a* in the hull 11. This transom bottom 21 includes a transom 22 and a projecting portion 23. The transom 22 has a nearly-vertical surface whose upper portion is located at a slightly rearward position with respect to its lower portion. The projecting portion 23 projects rearward from the transom 22 except for the left and right side portions and the bottom portion of the transom 22. That is, the transom 22 forms the surface of a vertical wall in the front of the recess 11*a*. More specifically, as shown in FIG. 3, the transom 22 preferably forms a surface with a bilaterally symmetrical V-shape (i.e., having left and right symmetrical portions) having a substantially constant width extending along the V-shaped lower edge of the hull 11.

When the projecting portion 23 is viewed from the rear, its lower edge preferably has a generally V-shape along the upper edge of the transom 22 and the upper edge has a linear shape extending horizontally in a horizontal direction. Thus, the projection portion 23 has a substantially bilaterally symmetrical triangular shape when viewed from the rear. When the shape of the projecting portion 23 is viewed from the side, its lower edge portion includes a short portion extending in a horizontal and rearward direction from a portion slightly upward from the lower end of the transom 22, a slanting portion extending rearwardly and upwardly from the rear end of the horizontal portion, and a portion extending rearwardly at an almost vertical angle from the rear end of the slanting portion. The upper edge portion of the profile of the projecting portion 23 includes a horizontal portion along the recess 11*a* and a slanting portion along the transom 22.

That is, the surface of the projecting portion 23 includes the parallel portion 23*a* that is longer in the fore-and-aft direction and that extends parallel to the hull 11, the slanting portion 23*b* located at the rear of the parallel portion 23*a* and having a width that decreases along a rearward direction and an upward direction, and the rear surface portion 23*c* including the almost vertical slanting surface. The installation portion 17*a* described above is provided on the upper surface of the projecting portion 23. As described above, the projecting portion 23 has bilaterally symmetrical convex surfaces, and the recess 17 is located to the rear of the rear-surface portion 23*c* of the projecting portion 23. A pair of outboard motors 24*a* and 24*b* is installed on the installation portion 17*a* provided on the upper surface of the projecting portion 23. The rear portion of each of the outboard motors 24*a* and 24*b* is located forward of the rear portions of the starboard-side step 16*a* and the port-side step 16*b* whereby the outboard motors 24*a* and 24*b* are protected from an impact from the rear.

The outboard motors 24*a* and 24*b* preferably have the same structure. The outboard motors 24*a* and 24*b* are installed on the installation portion 17*a* via installing members (not shown) such as swivel brackets or clamp brackets such that the outboard motors 24*a* and 24*b* can be pivoted by an operation of a tilt/trim apparatus (not shown) in vertical directions about a pivot shaft provided on the installation portion 17*a*. Although the internal structure is not shown in the drawings, each of the outboard motors 24*a* and 24*b* includes a lower case 25 in which a propeller unit is disposed, an upper case 26 disposed above the lower case 25 and connected thereto and in which a drive shaft is disposed, and a cowling 27 disposed above the upper case 26 and connected thereto and in which an engine is disposed.

The propulsion unit includes a propeller 28 connected to the rear end of a propeller shaft disposed in a substantially horizontal position. The lower end of a crankshaft connected to the engine is connected to the upper end of the drive shaft. Thus, when the engine operates, the driving force generated thereby is transmitted to the propeller 28 via the crankshaft, the drive shaft, and the propeller shaft, thereby rotating the propeller 28 and thus generating thrust. On the periphery of the upper portion of the lower case 25, there is provided a cavitation plate 29 to prevent the propeller 28 from drawing air. The cavitation plate 29 makes it possible to reduce the depth of the outboard motors 24*a* and 24*b* in the water. Furthermore, the cavitation plate 29 provides an improvement in drivability of the boat (A). Intake openings 27*a* including a plurality of small openings are provided in upper side portions of the cowling 27 so that air is taken from the outside into the cowling 27 via the intake openings 27*a*.

A side thruster 31 is disposed on a lower portion of the slanting portion 23*b* of the projecting portion 23. The side thruster 31 includes a tunnel 31*a* extending in a horizontal direction through the slanting portion 23*b* and a propeller 31*b* disposed in the middle of the tunnel 31*a* such that the propeller 31*b* is driven by a drive motor (not shown) disposed in the hull 11 whereby the propeller 31*b* rotates. The rotation of the propeller 31*b* causes water to flow in the tunnel 31*a* from one end thereof to the other end thereby moving the stern portion of the boat (A) in the right and the left direction. The rotation direction of the propeller 31*b* can be changed by the driving operation of the drive motor thereby to change the moving direction of the stern portion of the boat (A) to the left or the right.

Another side thruster 32 is provided in a lower portion of the front portion of the hull 11. The side thruster 32 includes a tunnel 32*a* extending in a horizontal direction through the bow portion of the hull 11 and a propeller 32*b* disposed in the middle of the tunnel 32*a* such that the propeller 32*b* is rotated by a drive motor (not shown). The rotation of the propeller 32*b* causes water to flow in the tunnel 32*a* from one end thereof to the other end thereby moving the bow portion of the boat (A) in the right and the left direction. The rotation direction of the propeller 32*b* can be changed by the driving operation of the drive motor thereby to change the moving direction of the bow portion of the boat (A) to the left or the right.

Figure 4:
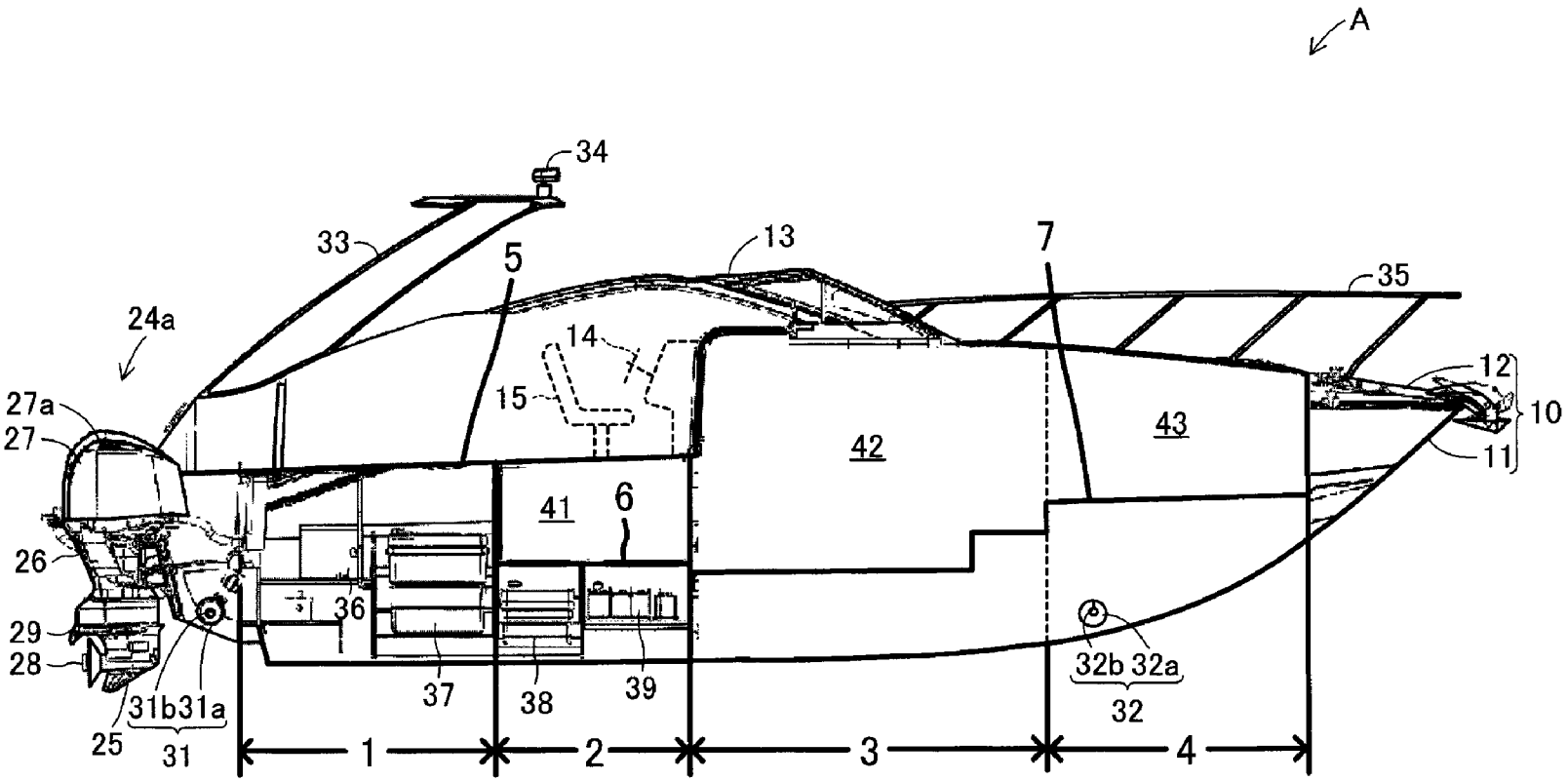
FIG. 4 is a side view illustrating sections in the boat.

A floating wing 33 in the shape of a gate extends diagonally in an upward and forward direction from the rear portion of the deck 12. A searchlight 34 is disposed on the upper surface of the floating wing 33. Furthermore, a handrail 35 is provided along the periphery of the deck 12 in a portion from the center to the front. As shown in FIG. 4, the inside of the boat body 10 is divided into sections for use as various rooms and installation spaces arranged to install an electric generator 36, a fuel tank 37, a fresh water tank 38, a battery 39, and the like. In FIG. 4, reference numerals 1 to 4 denote sections formed by partitioning the boat body 10 in the fore-and-aft direction, and reference numerals 5 to 7 denote boundary lines that partition the boat body 10 into upper and lower sections.

That is, a lower portion of a section denoted by a reference numeral 1 in the stern portion of the boat body 10 is a space arranged to install the electric generators 36 and the fuel tanks 37, and a lower portion of a section denoted by reference numeral 2 slightly rearward of the center of the boat body 10 is a space arranged to install the fresh water tank 38 and the battery 39. It should be noted that, two electric generators 36 and two fuel tanks 37 are preferably disposed such that one electric generator and one fuel tank are located on a left side and the other ones are located on a right side at positions corresponding to the outboard motors 24*a* and 24*b*. Lower portions of sections denoted by reference numerals 3 and 4 at the center and at the bow of the boat body 10 are spaces arranged to install various kinds of pipes and devices.

Reference numeral 5 denotes a deck floor line defining a floor of the deck 12 and also a ceiling of the portions denoted by reference numerals land 2. Reference numeral 6 denotes an under berth floor line that partitions the portion denoted by reference numeral 2 into upper and lower portions. The portion corresponding to the under berth floor line 6 defines a floor of an under berth 41 provided below the deck 12 and also a ceiling of the lower portion of the portion denoted by reference numeral 2. The under berth 41 is used as a room in which a chair or the like is provided so that the crew can rest in this room. Reference numeral 7 denotes a main cabin/bow berth floor line. A rear-portion of this line 7 is a main cabin floor line defining a floor of a main cabin 42 provided in an upper portion of the section denoted by reference numeral 3 and also a ceiling of a lower portion of the section denoted by reference numeral 3.

In the main cabin 42, a sofa, a shelf for placing various kinds of drinks or the like, and other articles are provided so that the crew of the boat (A) is allowed to relax in this main cabin 42. A front portion of the main cabin/bow berth floor line is a bow berth floor line defining a floor of a bow berth 43 provided in an upper portion of the section denoted by reference numeral 4 and also a ceiling of a lower portion of the section denoted by reference numeral 4. The bow berth 43 is also used as a room in which a chair or the like is provided for use by the crew so that crew is can rest in this room. In the boat (A), as described above, the spaces in the boat body 10 are used in a very efficient manner. Note that this boat (A) runs by the driving force provided by the outboard motors 24*a* and 24*b* and it is not necessary to install a motor or other driving machines in the inside of the boat body 10. This allows an increase in the space in the boat body 10, and an increased space can be used for various purposes. Note that the under berth 41, the main cabin 42 and the bow berth 43 function as cabins according to the present preferred embodiment.

When the boat (A) configured in the above-described manner is run, the crew including an operator and a plurality of passengers may board. For example, in a state where the boat (A) is at rest with its port side alongside a pier, the crew may get on the boat (A) from the low-location rear portion of the port-side step 16*b*, and may move to the cockpit 13, the main cabin, or other rooms via the higher-location front portion of the port-side step 16*b* and the stern deck 12*b* at a still higher location. After the operator sits on the operator's seat 15 in the cockpit 13, if the operator turns on the start switch disposed in the vicinity of the steering wheel 14, the boat (A) starts to run in accordance with operations of the operation lever or the steering wheel 14.

As the running speed of the boat (A) is increased, the boat position is inclined such that the bow is higher than the stern. If the running speed of the boat (A) exceeds a particular speed, the lower edge portion of the transom 22 cuts the surface of water, and the projecting portion 23 comes to a position above the surface of the water. This prevents the projecting portion 23 from generating resistance against the running of the boat (A). Furthermore, the lower portions of the outboard motors 24*a* and 24*b* are brought into a water flow rising up from the lower edge of the transom 22 in a rearward direction, thereby ensuring that the propellers 28 of the outboard motors 24*a* and 24*b* catch the water flow.

Thus, the boat (A) can run in a stable manner. In particular, when a turn is made at a high speed, it is possible to make the turn in a stable manner without drawing air. If the boat (A) stops on water, the projecting portion 23 goes down into the water. As a result, buoyancy is generated. The buoyancy prevents the stern portion, where the outboard motors 24*a* and 24*b* are installed, of the boat (A) from sinking down which would cause the boat (A) to greatly incline. In this state, it is possible to fish from the bow deck 12*a* or the stern deck 12*b*, or it is possible to bathe in the sun on the bow deck 12*a*.

To swim, it is possible to hang down a ladder into the water from the rear portion of the port-side step 16*b* so that the ladder is used to climb down into the water. Furthermore, as required, the crew is allowed to freely move on the transom platform 16 and the passageways 12*c* and 12*d*. When the boat (A) docks at a pier, smooth landing is possible by operating the two side thrusters 31 and 32. In the docking operation, the boat hook may be taken out of the storage portion 18 and used to move the boat (A) toward a pier, or a cushion may be taken out of the fender and used to reduce an impact when the boat (A) comes alongside the pier.

As described above, in the present preferred embodiment, the boat (A) is preferably constructed as a cruiser type boat capable of running by the driving force provided by the outboard motors 24*a* and 24*b*. Accordingly, it is not necessary to dispose a driving engine in the lower portion of the stern or the center portion in the boat body 10. This makes it possible to create extra space to install the electric generator 36, the fuel tank 37, the fresh water tank 38, and the battery 39, for example. The provision of the transom platform 16 functioning as passageways for use by the crew at the right, left, and front sides of the outboard motors 24*a* and 24*b* allows the crew to freely move not only on the bow deck 12*a*, the stern deck 12*b*, and the passageways 12*c* and 12*d*, but also around the outboard motors 24*a* and 24*b*.

Furthermore, in the boat (A), the rear portion of each of the starboard-side step 16*a* and the port-side step 16*b* extend rearward beyond the rear ends of the outboard motors 24*a* and 24*b*, thereby preventing the outboard motors 24*a* and 24*b* from being damaged when the stern of the boat (A) is brought into contact with a quay or the like or when some object hits the stern from the rear. Furthermore, because the outboard motors 24*a* and 24*b* are installed on the installation portion 17*a* provided on the upper surface of the projecting portion 23, it becomes possible for the crew to move over a greater range around the outboard motors 24*a* and 24*b*. Furthermore, in the boat (A), the steps 16*d* and 16*e* are arranged at substantially the middle, as seen in the fore-and-aft direction, of the starboard-side step 16*a* and the port-side step 16*b* such that the rear portion is lower than the front portion for both the starboard-side step 16*a* and the port-side step 16*b*.

This configuration makes it possible for the crew to more easily get on or off the boat (A) by using the rear portion of the starboard-side step 16*a* or the rear portion of the port-side step 16*b* when the crew gets on or off the boat (A). By raising the front portions of the starboard-side step 16*a* and the port-side step 16*b*, it becomes possible to increase the height of the bow deck 12*a* and the stern deck 12*b* such that the stern deck 12*b* is higher than a lower end of the cowling 27 (see FIG. 4), which makes it possible to provide a greater space below the bow deck 12*a* and the stern deck 12*b*. In this configuration, the crew is at a higher location distant from the outboard motors 24*a* and 24*b*, and thus the outboard motors 24*a* and 24*b* are hidden from the view of the crew, which leads to an increase in the appearance of the boat. Furthermore, noise from the outboard motors 24*a* and 24*b* is attenuated to a low level that is almost inaudible, which provides a comfortable driving environment.

Furthermore, in the boat (A), the storage portion 18 is arranged below the fore step 16*c*, and the boat hook may be placed in the storage portion 18. The storage portion 16*f* is arranged in the rear portion of the port-side step 16*b*, and the foldable ladder may be placed in the storage portion 16*f*. Thus, limited spaces are used efficiently. In the boat (A), the provision of the two outboard motors 24*a* and 24*b* makes it possible to output the driving force necessary to drive the boat of the cruiser type with a rather large size.

It is understood that the boat according to the present invention is not limited to the preferred embodiments described above, and many modifications are possible. For example, although in the preferred embodiments described above, two outboard motors 24*a* and 24*b* are preferably provided, the number of outboard motors is not limited to two. Only one outboard motor may be used, or, conversely, a number of outboard motors greater than two may be used depending on the size of the boat. In the preferred embodiments described above, the outboard motors 24*a* and 24*b* are preferably installed on the installation portion 17*a* disposed on the upper surface of the projecting portion 23. Alternatively, the outboard motors 24*a* and 24*b* may be installed directly on the transom 22 without providing the projecting portion 23. Furthermore, the shape of the boat is not limited to that according to the preferred embodiments described above. The boat may be constructed into any shape as long as the boat is capable of being driven by an outboard motor installed on the boat.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat comprising:

a boat body, a deck, a cabin for crew or passengers of the boat to rest and relax, and a cockpit for an operator of the boat;

an outboard motor installation recess located in a middle of a stern of the boat body;

an outboard motor installed on a front wall of the outboard motor installation recess, the outboard motor including a lower case housing a propeller, an upper case housing a drive shaft, and a cowling housing an engine; wherein the cockpit includes a steering wheel to steer the boat;

the deck includes a stern deck located rearward of the cockpit, and the stern deck and the cockpit share a same flat deck floor; and the stern deck is higher than a lower end of the cowling when the outboard motor is installed in the outboard motor installation recess.

2. The boat according to claim 1, further comprising a space below the stern deck, wherein the space houses at least one of an electric generator, a fuel tank, a fresh water tank, and a battery.

3. The boat according to claim 1, further comprising a left walking passageway to a left of the outboard motor installation recess, right walking passageway to a right of the outboard motor installation recess, and a front walking passageway to a front of the outboard motor installation recess.

4. The boat according to claim 3, wherein a rear portion of each of the left walking passageway and the right walking passageway projects rearward beyond a rear end of the outboard motor.

5. The boat according to claim 3, wherein each of the left walking passageway and the right walking passageway includes a step or a sloped portion such that a front portion of the step or the sloped portion is higher than a rear portion of the step or the sloped portion.

6. The boat according to claim 3, further comprising a storage portion below at least a portion of the left walking passageway, the right walking passageway, or the front walking passageway.

7. The boat according to claim 1, further comprising a projecting portion that projects rearward from a transom on the stern of the boat, wherein the outboard motor is installed on the projecting portion.

8. The boat according to claim 1, further comprising a plurality of outboard motors installed in the outboard motor installation recess such that the plurality of outboard motors are located side-by-side in a width direction of the boat.

9. The boat according to claim 1, wherein the cabin includes a main cabin forward of the cockpit, and a floor of the cockpit is higher than a floor of the main cabin and lower than a ceiling of the main cabin.

10. The boat according to claim 1, wherein the cabin includes a main cabin forward of the cockpit, and the stern deck is higher than a floor of the main cabin.

11. The boat according to claim 1, further comprising a berth cabin for the crew of the boat to rest and relax, wherein the berth cabin is directly below the stern deck.

* * * * *